US005163761A

United States Patent [19]

Horii et al.

[11] Patent Number: 5,163,761

[45] Date of Patent: Nov. 17, 1992

[54] DOT PRINT HEAD

[75] Inventors: Masami Horii; Takashi Kondoh, both of Shizuoka, Japan

[73] Assignee: Tokyo Electric Co., Ltd., Tokyo, Japan

[21] Appl. No.: 787,632

[22] Filed: Nov. 4, 1991

[30] Foreign Application Priority Data

Nov. 9, 1990 [JP] Japan ..... 2-304895

[51] Int. Cl.[5] ..... B41J 2/25

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,433,927 | 2/1984 | Cavallari | 400/124 |
| 4,541,745 | 9/1985 | Gugel . | |
| 4,594,010 | 6/1986 | Jachno . | |
| 4,723,854 | 2/1988 | Sakaida et al. | 400/124 |
| 4,884,905 | 12/1989 | Smith | 400/124 |
| 5,009,528 | 4/1991 | Horii et al. | 400/124 |
| 5,033,885 | 7/1991 | Gugel et al. | 400/124 |

FOREIGN PATENT DOCUMENTS

| | | | |
|---|---|---|---|
| 54-18323 | 2/1979 | Japan . | |
| 0124959 | 6/1987 | Japan | 400/124 |

*Primary Examiner*—Edgar S. Burr
*Assistant Examiner*—Lynn D. Hendrickson
*Attorney, Agent, or Firm*—Oblon, Spivak, McClelland, Maier & Neustadt

[57] ABSTRACT

A dot print head includes an armature assembly constructed by providing an armature guide holding a plurality of armatures for swing motion in a cup-shaped housing having one open end, slidably guiding a plurality of print wires attached to the inner ends of the armatures by a wire guide, interposing armature return springs between the armatures and the armature guide, disposing an armature stopper in contact with the backsides of the armatures opposite to the front sides of the same facing the armature guide, and disposing stopper seats between the inner surface of the bottom wall of the housing and the inner surface of the armature stopper; and a yoke assembly joined and fastened to the armature assembly with fastening members.

5 Claims, 4 Drawing Sheets

DOT PRINT HEAD

FIELD OF THE INVENTION AND RELATED ART STATEMENT

The present invention relates to a dot print head employing print wires driven by armatures.

A conventional dot print head as shown in FIG. 4 is completed by assembling an armature assembly 59 and a yoke assembly 66, which are assembled individually. The armature assembly 59 comprises a housing 51 having a mounting bracket 50 to be fastened to the carriage of a printer, an armature guide 53 fixed to the housing 51, a plurality of armatures 52 held for swing motion on the armature guide 53, print wires 54 fixed to the inner ends of the armatures 52, respectively, a wire guide 56 for guiding the print wires 54, fixed to the housing 51, armature return springs 57 provided between the armatures 52 and the armature guide 53, and armature holding springs 58 provided between the armature 52 and the armature guide 53. The yoke assembly 66 comprises a yoke 62 integrally provided around its periphery with a plurality of cores 61 respectively corresponding to the armatures 52, coils 60 wound respectively on the cores 61, an armature stopper 63 fixed to the central portion of the yoke 62, and a case 65 with fins 64 fixed to the backside of the yoke 62. The armature assembly 59 and the yoke assembly 66 are joined and fastened together with a plurality of screws 67 to complete the dot print head. The armatures 52 are pressed toward the cores 61 by the armature holding springs 58 and pressed against the armature stopper 63 by the armature return springs 57. When the coil 60 is energized, the armature 52 is attracted to the core 61, so that the inner end of the armature 52 to which the print wire 54 is fixed is separated from the armature stopper 63. Consequently, the free end of the print wire 54 strikes through an ink ribbon against a sheet wound around a platen to print a dot. Upon the de-energization of the coil 60, the armature 52 is returned to its standby position on the armature stopper 63 by the armature return spring 57.

The armature assembly 59 and the yoke assembly 66 of the conventional dot print head shown in FIG. 4 are assembled individually before assembling the dot print head. However, it is possible that the armatures 52 are caused to fall off the armature guide 53 by the resilience of the armature return springs 57 and the armature holding springs 58, and the print wires 54 fall off guide chips 55 before the armature assembly 59 is joined to the yoke assembly 66. Therefore, the armature assembly 59 must be reassembled in joining the armature assembly 59 to the yoke assembly 66, requiring very troublesome work. The open end 51*a* of the housing 51 to be joined to the end surface of the case 65 must be machined correctly or correct gaps cannot be secured between the armatures 52 and the corresponding cores 61, which requires complicated assembling work. Printers of different types operate in different printing modes. Some dot print heads operate at a low working temperature. The mounting bracket 50 of such a dot print head need not be formed of aluminum having excellent heat radiating characteristics, sacrificing the cost of the dot print head. Furthermore, the shape and dimensions of the mounting bracket 50 must be determined so that the mounting bracket 50 fits the carriage of a printer on which the dot print head is to be mounted. However, as mentioned before, the housing 51 integrally provided with the mounting bracket 50, produced by die-casting aluminum and finished by machining in accurate dimensions is expensive.

OBJECT AND SUMMARY OF THE INVENTION

A first object of the present invention is to facilitate assembling a dot print head.

A second object of the present invention is to improve the facility of assembling an armature assembly of a dot print head that is completed by assembling the armature assembly and a yoke assembly.

A third object of the present invention is to facilitate adjusting the gaps between armatures and cores.

A fourth object of the present invention is to provide a dot print head comprising an armature assembly and a yoke assembly that can be used in combination with printers of different types.

A fifth object of the present invention is to enable fabricating a stopper seat at a comparatively low cost.

In accordance with a first present invention, a dot print head comprises: an armature assembly comprising a plurality of armatures, a cup-shaped housing, an armature guide fixed to the housing and supporting the armatures so that the armatures are able to swing, print wires attached respectively to the inner ends of the armatures, a wire guide fixed to the housing to guide the print wires for sliding movement, armature return springs disposed between the armatures and the armature guide, an armature stopper fixedly provided on the housing so as to be in contact with the backsides of the armatures opposite to the front sides of the same facing the armature guide, and stopper seats disposed between the bottom surface of the housing and the inner surface of the armature stopper and fixed to the housing; and a yoke assembly comprising a yoke integrally provided with a plurality of cores arranged so as to be disposed opposite to the armatures, coils wound on the cores, and a printed wiring board attached to the backside of the yoke and electrically connected to the coils, and joined and fastened to the armature assembly with fastening means. Since the armatures biased away from the armature guide by the armature return springs are in contact with the armature stopper disposed so as to be in contact with the backsides of the armatures, the armatures are held in place by the armature stopper and hence the armatures are unable to fall off the housing before the armature assembly and the yoke assembly are joined together. The position of the armature stopper and that of the standby positions of the armatures can properly be determined by properly adjusting the thickness of the stopper seats disposed between the bottom surface of the housing and the armature stopper. Accordingly, the armatures can readily be disposed relative to the cores with an appropriate gap therebetween when the armature assembly and the yoke assembly are joined together.

In accordance with a second invention, screws are used as fastening means for fastening together the housing, the armature guide, the wire guide, the stopper seat and the armature stopper of the armature assembly. Accordingly, the armature assembly can very easily be assembled and has a simple construction.

In accordance with a third invention, a mounting bracket, the armature assembly and the yoke assembly are fastened together by fastening members. Since the mounting bracket can be separated from the armature assembly and the yoke assembly, the mounting bracket can be replaced with another mounting bracket having a shape and dimensions fitting the shape and dimensions of the carriage of a printer on which the dot print head is to be mounted, and hence the armature assembly and the yoke assembly can commonly be used in combination with printers of different types.

In accordance with a fourth invention, the stopper seat employed in the dot print head is formed of zinc by die-casting. The zinc stopper seat is inexpensive.

DETAILED DESCRIPTION OF THE PREFERRED EMBODIMENT

Figure 1:
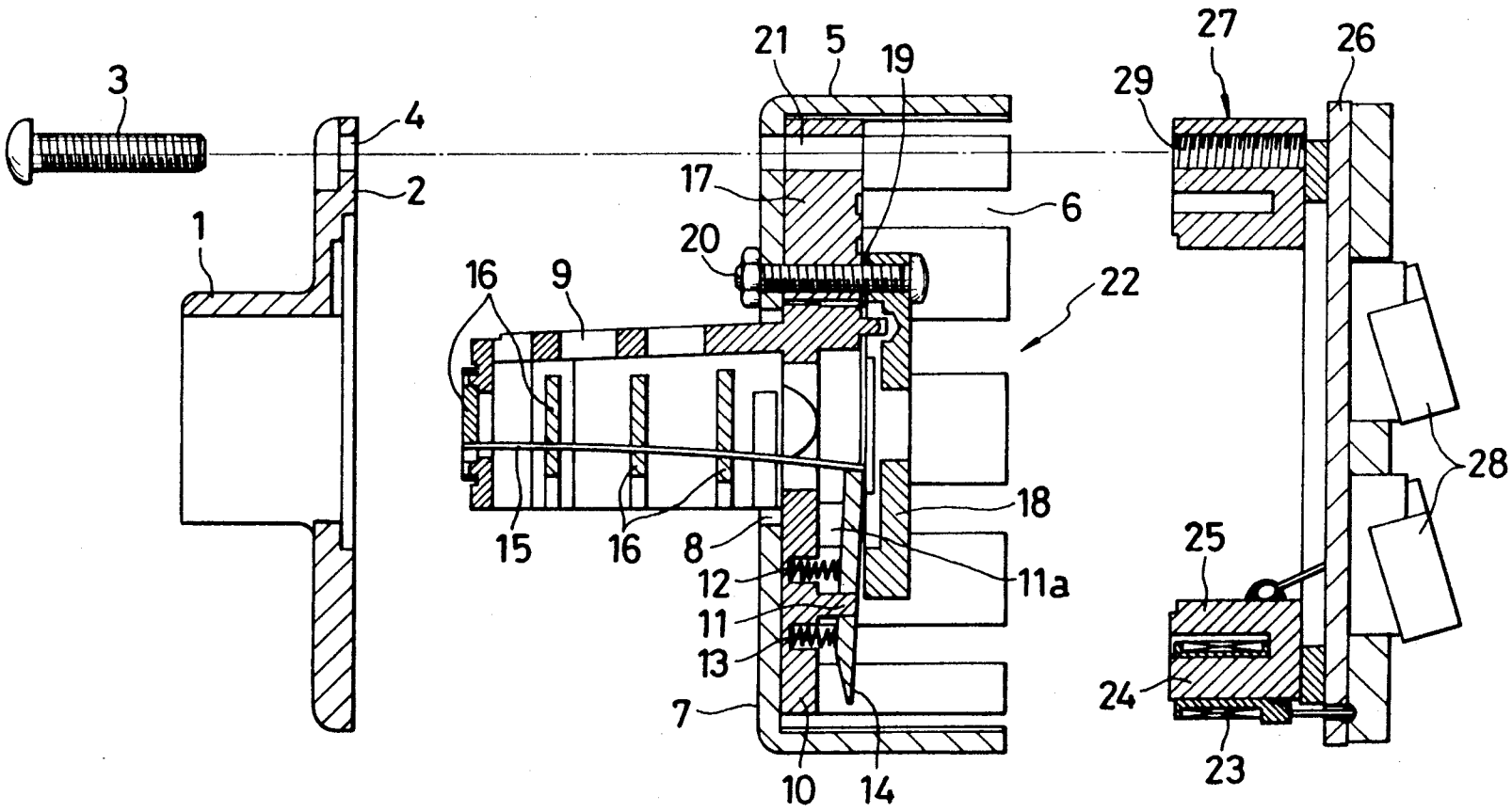
FIG. 1 is an exploded longitudinal sectional view of a dot print head embodying the present invention.
Figure 2:
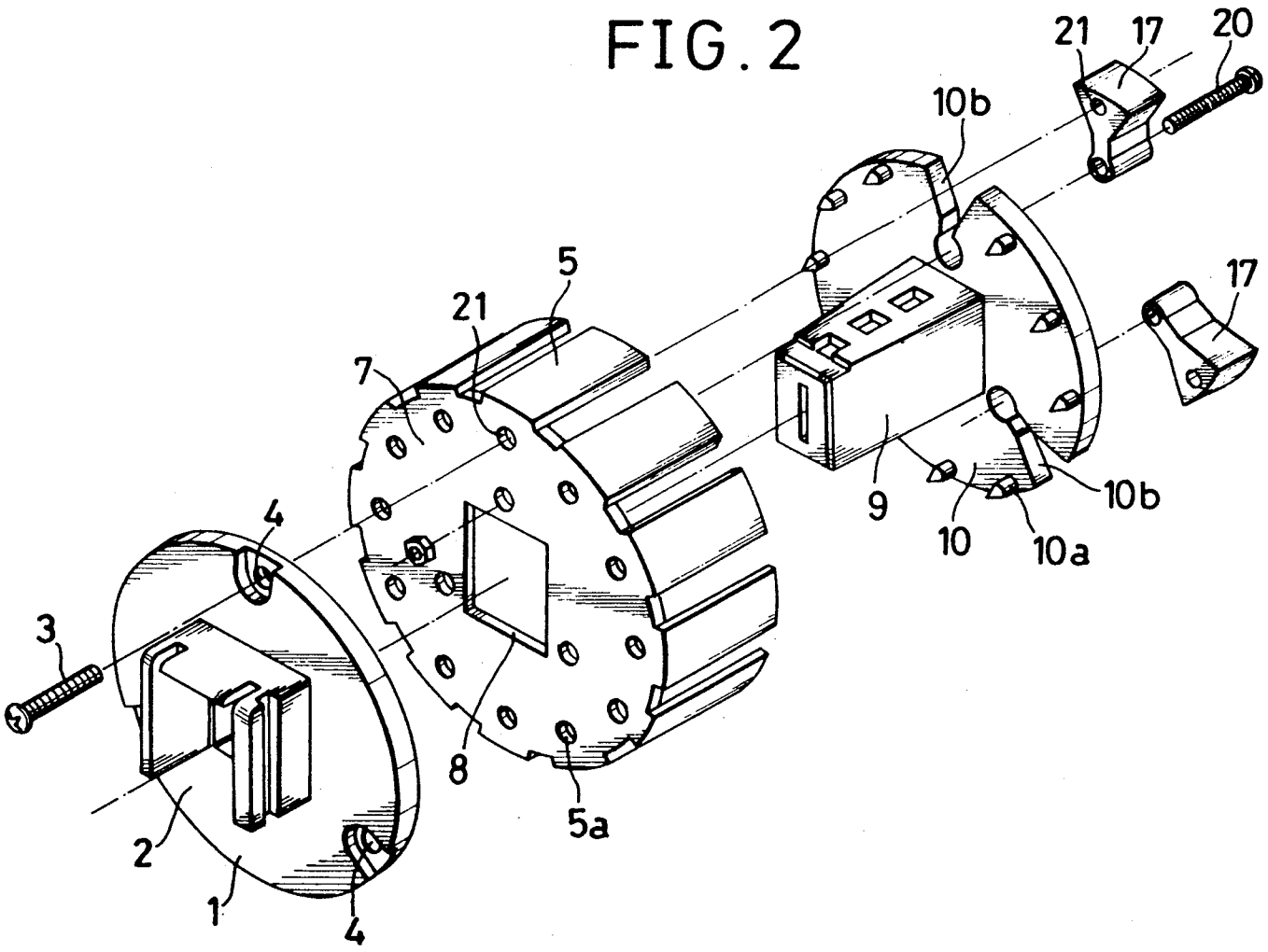
FIG. 2 is an exploded perspective view of an armature assembly included in the dot print head of FIG. 1.
Figure 3:
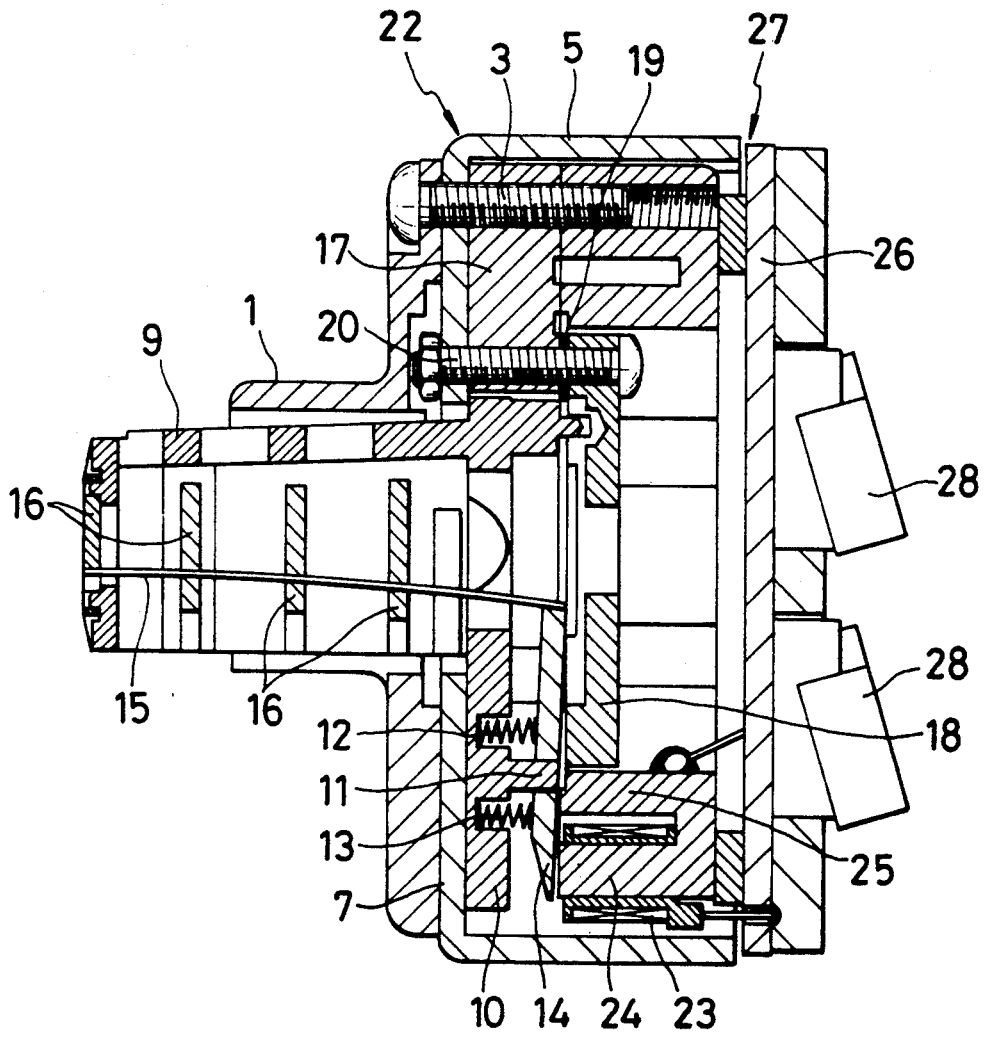
FIG. 3 is a longitudinal sectional view of the dot print head of FIG. 1.
Figure 4:
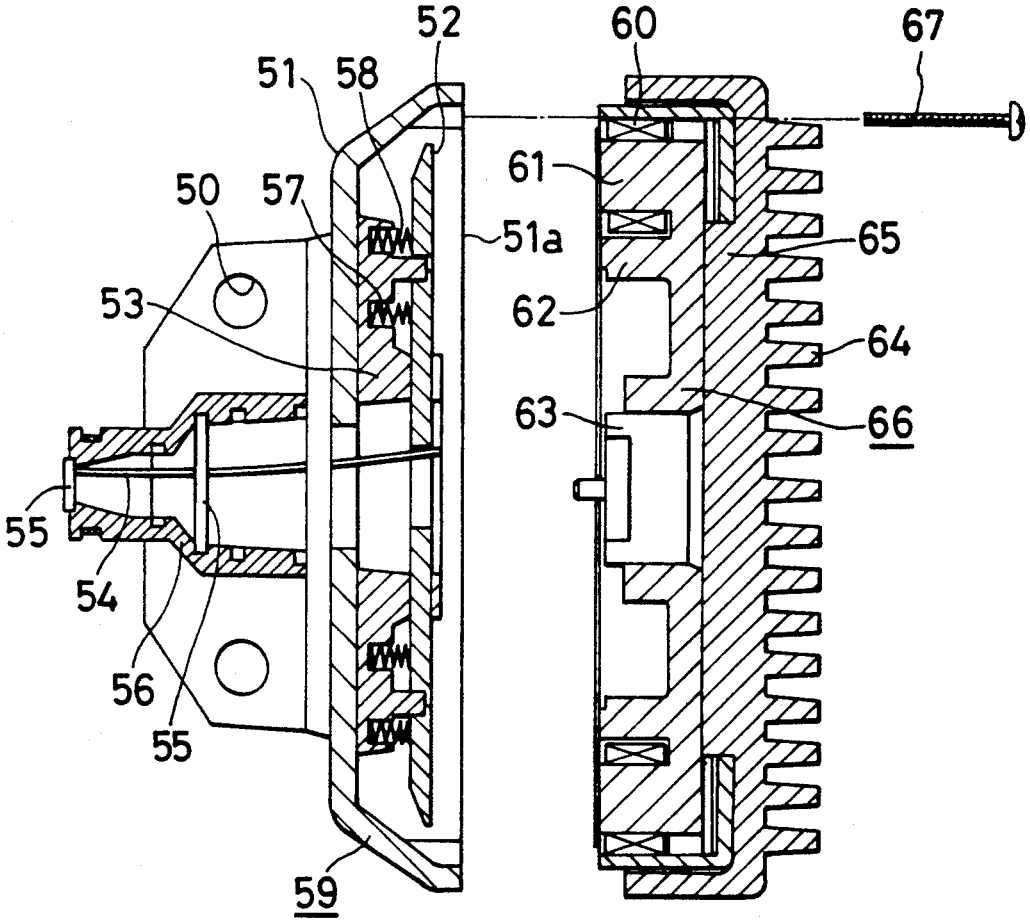
FIG. 4 (PRIOR ART)
FIG. 4 is an exploded longitudinal sectional view of a conventional dot print head.

A dot print head in a preferred embodiment according to the present invention will be described hereinafter with reference to FIGS. 1 to 3.

A mounting bracket 1 to be attached to the carriage of a printer has a flange 2 provided with a plurality of through holes 4 for receiving screws 3 (second fastening means) therethrough, respectively.

A housing 5 having one open end is formed by pressing an aluminum plate for satisfactory heat release. A plurality of openings 6 are formed in the circumferential wall of the housing 5, and a square hole 8 is formed in the central portion of the bottom wall 7 of the housing 5. A wire guide 9 is provided integrally with an armature guide 10. When the wire guide member 9 is set in the square hole 8 of the bottom wall 7, the armature guide 10 is seated on the inner surface of the bottom wall 7 in close contact with the inner surface of the bottom wall 7. The armature guide 10 has a plurality of posts 11 and a plurality of guide ridges 11*a*. A plurality of armature return springs 12 are put in recesses formed in the armature guide 10 on the inner side of the posts 11, and a plurality of armature holding springs 13 are put in recesses formed in the armature guide 10 on the outer side of the posts 11. Armatures 14 are arranged radially in grooves defined by the guide ridges 11*a*, respectively and are supported on the posts 11, respectively, for swing motion. A plurality of print wires 15 attached respectively to the inner ends of the armatures 14 are guided for sliding motion by guide chips 16 fixed to the wire guide 9. As shown in FIG. 2, the armature guide 10 is provided with a plurality of radial recesses 10*b*, and stopper seats 17 formed of zinc by die-casting are set in the radial recesses 10*b*, respectively, and are seated on the inner surface of the bottom wall 7 of the housing 5. A circular armature stopper 18 placed in contact with the backsides of the armatures 14, a thin shim 19, the stopper seats 17 are fastened to the bottom wall 7 with screws 20 (first fastening means). The bottom wall 7 is provided with a plurality of through holes 21 for receiving the screws 3 therethrough. Each stopper seat 17 is provided with a through hole 21 for receiving the screw 20 therethrough. The bottom wall 7 of the housing 5 is provided with a plurality of holes 5*a* for receiving projections 10*a* formed on the armature guide 10. In assembling an armature assembly 22, the wire guide 9 is set in the square hole 8 of the bottom wall 7 of the housing 5 with the projections 10*a* fitted in the corresponding holes 5*a*, the armatures 14 are placed respectively in guide grooves defined by the guide ridges 11*a* so as to be supported on the posts 11 with the print wires passed through the guide chips 16, the shim 19 is placed on the outer surface of the armature guide 10, the armature stopper 18 is placed on the shim 19, the stopper seats 17 are fitted in the radial recesses 10*b* of the armature guide 10, the armature stopper 18 is seated on the stopper seats 17, and then the armature guide 10, the shim 19, the stopper seats 17 and the armature stopper 18 are fastened to the bottom wall 7 of the housing 5 with the screws 20.

A yoke 25 is provided integrally with a plurality of cores 24. Coils 23 are wound respectively on the cores 24, and a printed wiring board 26 is attached to the backside of the yoke 25 and connected electrically to the coils to complete a yoke assembly 27. The printed wiring board 26 is provided fixedly with connectors 28 for connecting the printed wiring board 26 to an external circuit. The yoke 25 is provided with a plurality of threaded holes 29 that engage the screws 3. The threaded holes 29 are arranged on a circle.

The screws 3 are inserted through the through holes 4 of the mounting bracket 1, and the through holes 21 formed in the housing 5 and the stopper seats 17 and screwed in the threaded holes 29 of the yoke 25 to complete the dot print head.

The coils 23 are energized selectively to attract the corresponding armatures 14 to the cores 24 so that the corresponding print wires 15 strike through an ink ribbon against a sheet wound on a platen for printing. When the coil 23 is de-energized, the armature 14 is returned to its standby position on the armature stopper 18 by the armature return spring 12.

Although the armatures 14 are biased by the armature return springs 12 and the armature holding springs 13, the armatures 14 are unable to fall off the armature guide 10 even before the armature assembly 22 is joined to the yoke assembly 27, because the outward movement of the armatures 14 relative to the armature guide 10 is limited by the armature stopper 18. The position of the armature stopper 18 relative to the armature guide 10, and the standby positions of the armatures 14 are dependent on the height of the stopper seats 17, namely, the thickness of the stopper seats 17. The shim 19 of an appropriate thickness is interposed between the stopper seats 17 and the armature stopper 18 for the further accurate determination of the standby positions of the armatures 14. Such an arrangement of the armatures 14, the shim 19 and the armature stopper 18 facilitates the adjustment of the gaps between the armatures 14 and the corresponding cores 24.

Furthermore, since the mounting bracket 1 to be attached to the carriage of a printer can be separated from the armature assembly 22 and the yoke assembly 27, and can be replaced with another one, a mounting bracket formed of a material and having dimensions suitable for the carriage of a printer can be combined with the armature assembly 22 and the yoke assembly 27, and hence the armature assembly 22 and the yoke assembly 27 can commonly be used in combination with printers of different types.

Still further, forming the stopper seats 17 of zinc by die-casting enables the stopper seats 17 to be manufactured at a comparatively low cost.

What is claimed is:

1. A dot print head comprising:

a cup shaped housing having a bottom wall with an inner surface;

an armature guide having a plurality of radial recesses, said armature guide being fitted in said cup shaped housing in facing relation with said bottom wall;

a plurality of radially arranged armatures supported at a backside of the armature guide opposite said bottom wall for swing motion on the armature guide;

a plurality of print wires attached to radially inner ends of the armatures, respectively;

armature return springs interposed between said armatures and said armature guide;

stopper seats fitted in said radial recesses;

an armature stopper mounted to said stopper seats and located at the backside of the armature guide, said armature stopper being spaced from said armature guide by a spacing dependent on a thickness of said stopper seats, said spacing being sufficient to permit the swing motion of said armatures while preventing the armatures from falling off of the armature guide;

first fastening means for fastening the stopper seats and armature stopper to said housing;

a yoke assembly; and second fastening means for fastening the housing, armature guide and yoke assembly into a unit.

2. A dot print head according to claim 1, wherein the first fastening means comprises screws.

3. A dot print head according to claim 1, including a mounting bracket to be attached to the carriage of a printer, the second fastening means fastening the mounting bracket to the unit of the armature guide, housing and yoke assembly.

4. A dot print head according to claims 1 or 2, wherein said stopper seats are formed of zinc by die-casting.

5. The dot print head of claim 1 wherein said yoke assembly includes a yoke having a plurality of cores, coils wound on the cores, and a printed wiring board attached to the yoke and electrically connected to the coils.

* * * * *